United States Patent [19]

Kikuchi et al.

[11] Patent Number: 5,073,126

[45] Date of Patent: Dec. 17, 1991

[54] ELECTRICAL CONNECTOR HOUSING HAVING CONDUCTOR-RETENTION MEANS

[75] Inventors: Shoji Kikuchi, Hiratsuka; Tetsuyuki Furuya, Yokohama, both of Japan

[73] Assignee: AMP Incorporated, Harrisburg, Pa.

[21] Appl. No.: 608,603

[22] Filed: Oct. 30, 1990

Related U.S. Application Data

[63] Continuation of Ser. No. 112,970, Oct. 23, 1987, abandoned.

[30] Foreign Application Priority Data

Nov. 7, 1986 [JP] Japan ..... 61-170968

[51] Int. Cl.[5] ..... H01R 13/58

[52] U.S. Cl. ..... 439/452; 439/460; 439/397

[58] Field of Search ..... 439/452, 460, 468, 586, 439/395–407

[56] References Cited

U.S. PATENT DOCUMENTS

| | | | |
|---|---|---|---|
| 3,660,801 | 5/1972 | Paulfus | 339/97 |
| 3,767,841 | 10/1973 | Anderson et al. | 174/84 C |
| 3,950,065 | 4/1976 | Renn | 339/98 |
| 4,074,929 | 2/1978 | Krider | 439/460 |
| 4,097,106 | 6/1978 | Over et al. | 339/99 R |
| 4,178,055 | 12/1979 | Fleischhacker et al. | 439/402 |
| 4,255,009 | 3/1981 | Clark | 339/97 |
| 4,514,027 | 4/1985 | Seidel | 339/105 |
| 4,527,852 | 7/1985 | Dechelette | 439/396 |
| 4,653,831 | 3/1987 | Wilson et al. | 439/404 |
| 4,693,536 | 9/1987 | Colleran et al. | 439/404 |
| 4,722,699 | 2/1988 | Heng et al. | 439/396 |

FOREIGN PATENT DOCUMENTS

| | | | |
|---|---|---|---|
| 0005876 | 5/1979 | European Pat. Off. . | |
| 0104013 | 3/1984 | European Pat. Off. | 439/400 |
| 1558582 | 11/1976 | United Kingdom . | |
| 1584909 | 4/1978 | United Kingdom . | |
| 2040601 | 12/1979 | United Kingdom . | |
| 2089147 | 12/1981 | United Kingdom . | |

OTHER PUBLICATIONS

P. 10 of AMP Publication HB5476, Rev A. Copyrights 1980 and 1984.

AMP Publication CI 8050 89 Dated 04/06/84.

Patent Search 8724409.

*Primary Examiner*—David L. Pirlot

*Attorney, Agent, or Firm*—Allan B. Osborne

[57] ABSTRACT

An electrical connector comprises electrical contacts (1) having termination slots (2) for cutting into insulation (4*a*) of an electrical conductor (4) when electrical conductor (4) is forced into slots (2) with edges of slots (2) electrically engaging conductor core (4*b*) of electrical conductor (4). An insulated housing (10) has openings (11) for receiving and retaining electrical contacts (1) therein and including conductor-retention grooves (12) opening outwardly for receiving a portion of the electrical conductors (4) therein. Conductor-retention arms (13) are located at an open end of the conductor-retention grooves (12) for retaining electrical conductors (4) therein. Projections (14) are located on the conductor-retention arms (13) for clampingly engaging insulation (4*a*) of electrical conductors (4) providing an axial strain relief thereon and to prevent shrinkage of the insulation away from the termination between conductors (4) and slots (2).

1 Claim, 2 Drawing Sheets

ELECTRICAL CONNECTOR HOUSING HAVING CONDUCTOR-RETENTION MEANS

This application is a Continuation of Application Ser. No. 07/112,970 filed Oct. 23, 1987, now abandoned.

FIELD OF THE INVENTION

The present invention relates to an electrical connector and more particularly to an electrical connector housing having conductor-retention means for retaining electrical conductors terminated to electrical contacts in position within the housing.

BACKGROUND OF THE INVENTION

A prior art connector is shown in FIG. 4, which retains in insulated housing 5 electrical contacts 1 having aligned slots 2. Housing 5 has contact-receiving openings 6 which are arranged laterally one next to another for receiving and retaining contacts 1 therein. As one end of an insulated electrical conductor 4 is forcefully moved downwardly in a direction perpendicular to the axis of the conductor and forced into slots 2 of each contact 1, the edges of slots 2 will cut into insulation 4*b* and electrically engage conductor core 4*a* to form an electrical connection therewith. Each contact-receiving opening 6 is provided with a groove 7 for guiding conductor 4 during its movement into the housing and for retaining a portion of conductor 4 adjacent contact 1. A pair of resilient retaining arms 8 is located at the entrance of each opening of groove 7. These arms are resiliently deformed to allow a portion of conductor 4 to move into groove 7 when the electrical conductor is forced into slots 2 of contact 1 within opening 6 thereby retaining the conductor in groove 7 as shown in FIG. 5. FIG. 6 illustrates the condition of the conductor thus seated in slots 2, which shows that the slot edges of slots 2 cut into the insulation 4*b* of conductor 4 to form electrical connection with the conductor core 4*a* terminated in slots 2.

In prior art connectors described above, a gap may be easily formed between retention arms 8 and conductor 4 in retention groove 7. Then, although retention arms 8 serve to retain the electric conductor in groove 7 against an upwardly-directed force, they cannot operate to apply a retaining force on the conductor when a longitudinal external force is applied to the conductor which will affect the termination of conductor 4 in slots 2 of contact 1.

These connectors are usually soldered to a printed circuit board 9 and the like as shown in FIG. 5 by soldering legs 3 of contacts 1 extending beneath the housing 5 with solder 9*b*. The heat generated in such soldering operation is conducted to insulated conductor 4 thereby causing the insulation to shrink in a direction away from the termination section of contact 1. This shrinkage may cause the conductor core 4*a* to be exposed at the termination, which in turn becomes a further source of connection failure due to corrosion occurring between the conductor core and the contact.

SUMMARY OF THE INVENTION

It is an object of the present invention to overcome the problem that a conventional connector is liable to cause when a poor electrical connection takes place between an insulated electrical conductor and an electrical contact. This problem is overcome by clamping a portion of the insulated electrical conductor in a conductor-retention groove in a housing as the conductor is terminated to the electrical contact. In order to fulfill this object, the electrical connector of the present invention is constructed as follows:

An electrical connector comprises electrical contacts having slotted portions each of which cuts into insulation of an insulated electrical conductor when forced into the slotted portions and electrically engages a conductor core of the conductor, and an insulated housing for retaining the contacts in such a way that the slots of the contacts are open outwardly. The housing is provided with conductor-retention grooves which open in the same direction as the slots for receiving the electrical conductors. At each open end of the conductor-retention grooves, paired retention arms are located each of which is further provided with a first projection that engages a portion of the insulated conductor received in the groove for clamping the conductor therein and providing an axial strain relief thereon.

By constructing the electrical connector as above, the portion of the conductor adjacent to such slotted portions is forced into the conductor-retention groove as the conductor is forced into the slots of the contact in the insulated housing, and the conductor so forced in the conductor-retention groove is clamped firmly by the first projections on the retention arms. A second projection may be located at the bottom of the conductor-retention groove. The first projections on the retention arms force the conductor onto the second projection so that the first and second projections tightly clamp the conductor in position in the conductor-retention groove thereby providing an axial strain relief on the conductor.

The clamping forces exerted by the projections onto the conductor control the amount of shrinkage of the insulation away from the terminating section when the contact is soldered onto a circuit board so that a sealed connection is maintained between the conductor and the contact.

BRIEF DESCRIPTION OF THE DRAWING

An electrical connector according to this invention will now be described by way of example with reference to the accompanying drawings, in which.

DETAILED DESCRIPTION OF THE INVENTION

Figure 1:
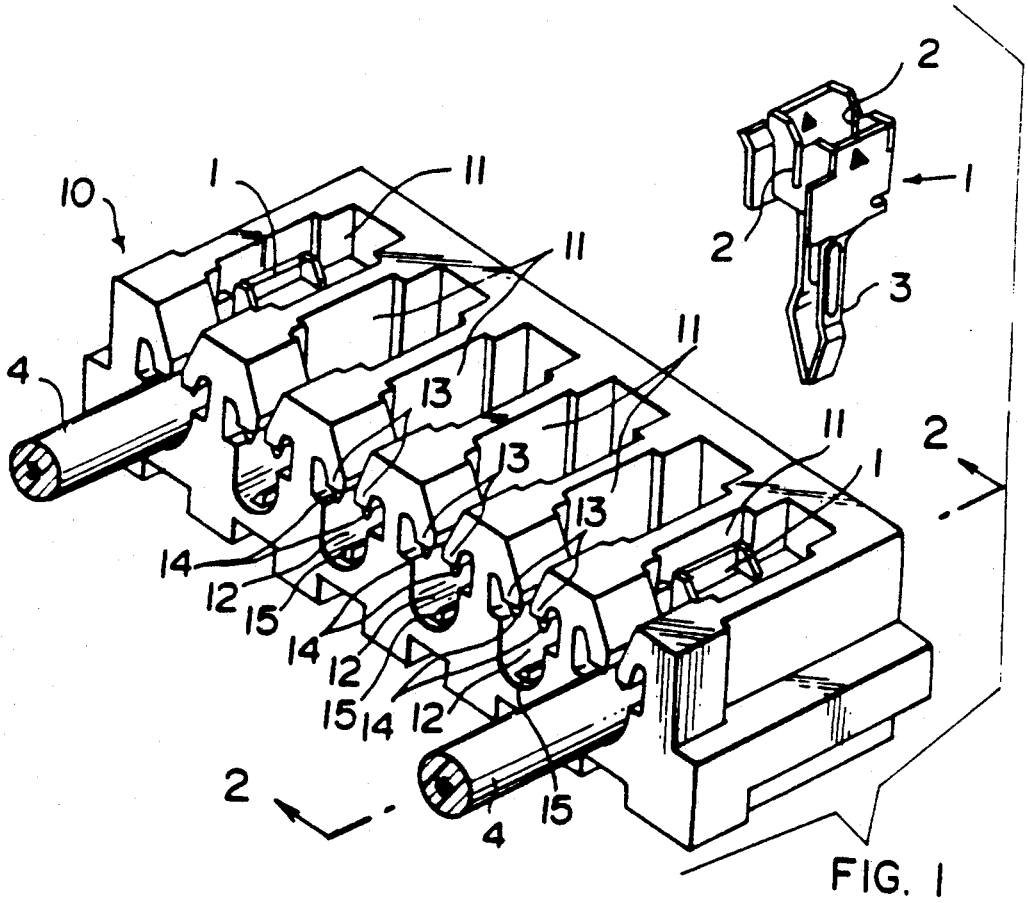
FIG. 1 is a perspective view of an electrical connector according to the present invention.
Figure 2:
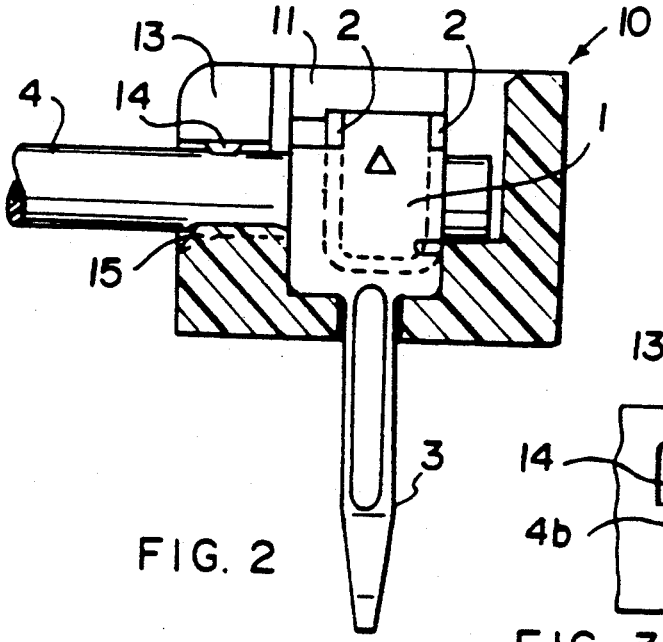
FIG. 2 is a cross-section taken along the line II—II in FIG. 1.
Figure 4:
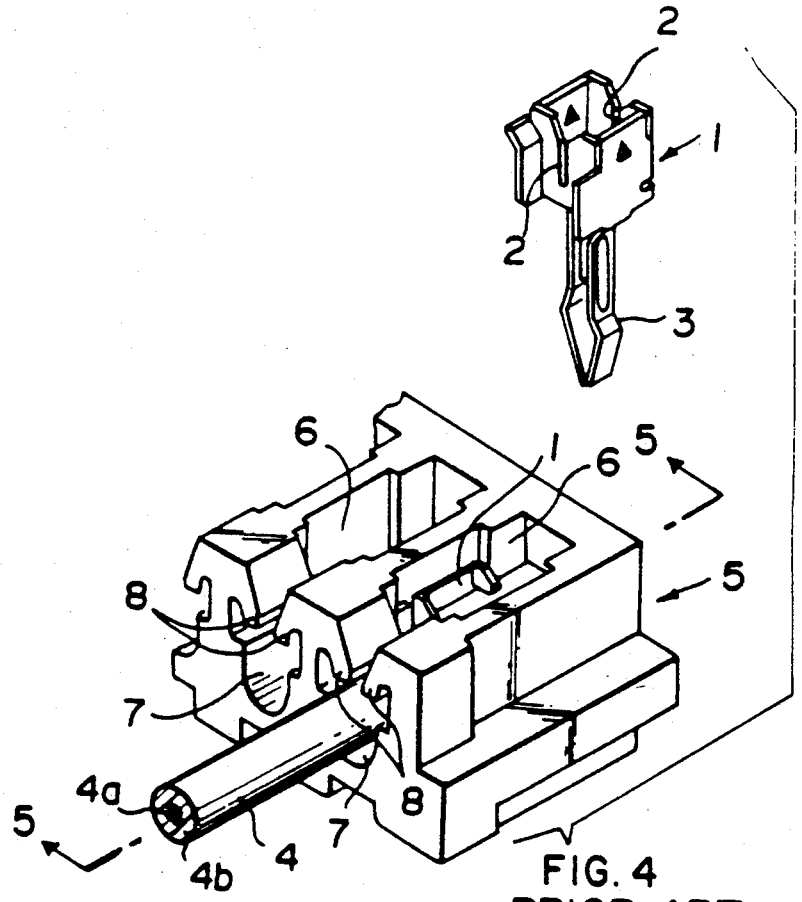
FIG. 4 PRIOR ART
FIG. 4 is a perspective view of a conventional electrical connector.
Figure 5:
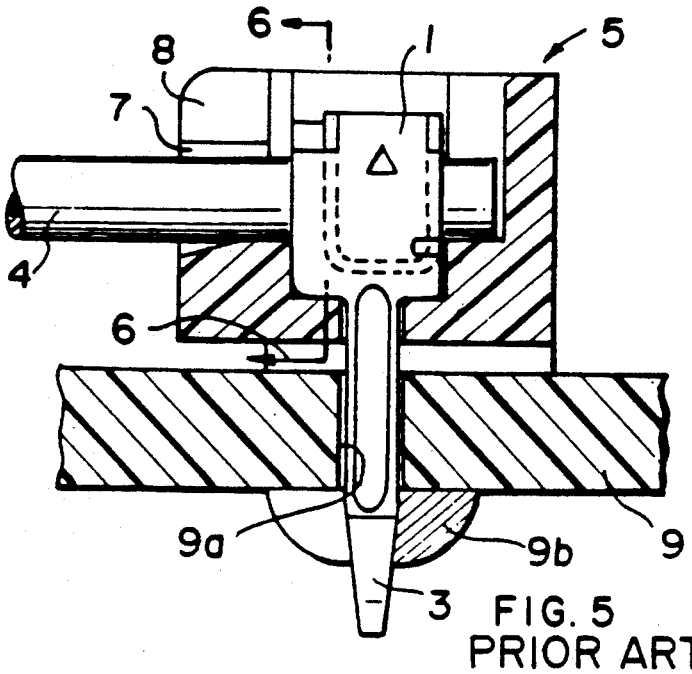
FIG. 5 PRIOR ART
FIG. 5 is a cross-section taken along the line V—V in FIG. 4.
Figure 6:
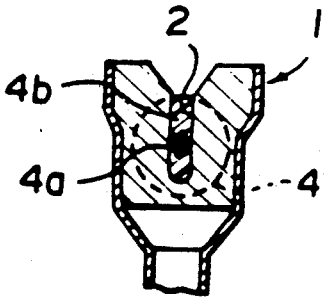
FIG. 6 PRIOR ART
FIG. 6 is another cross-section taken on the line VI—VI in FIG. 5.

As shown in FIG. 1, the electrical connector according to the present invention comprises an insulated housing 10 and a multiplicity of electrical contacts 1 to be secured in housing 10. Incidentally, contact 1 is of conventional construction having a pair of termination sections including aligned slots 2 and legs 3 as shown in FIG. 4. Housing 10 has a multiplicity of openings 11 for receiving contacts 1 laterally one next to another with their slots 2 open upwardly. Contacts 1 can be retained in respective openings 11 with their legs 3 extending outwardly from a bottom surface of housing 10 as shown in FIG. 2. As an end portion of an insulated electrical conductor 4 is forced in to slots 2 of contact 1, the slot edges cut into insulation 4*b* of conductor 4 and electrically engage conductor core 4*a* forming an electrical connection therebetween in the same manner as shown in FIG. 6.

At one side of each opening 11 of housing 10, a U-shape conductor-retention groove 12 is located for retaining electrical conductor 4 therein after conductor 4 is forced in slots 2 of contact 1. A pair of resilient retention arms 13 are located at the open end of each conductor-retention groove 12 and they extend inwardly in the same manner as the conventional retention arms 8 (FIG. 4). However, a first projection 14 is located on each of retention arms 13 and projections 14 extend downwardly towards the bottom of conductor-retention groove 12. A second projection 15 is located at the bottom of each groove 12 which extends upwardly towards first projections 14.

Figure 3:
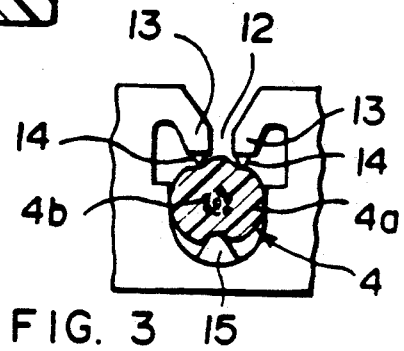
FIG. 3 is a part rear view of the connector shown in FIG. 1.

In connecting an end of electrical conductor 4 to the electrical connector, the end of the conductor is forcefully moved downwardly in a direction perpendicular to its axis until the end of conductor is forced into slots 2 and in the conductor-retention groove 12 as shown in FIGS. 1-3. It can be seen that the edges of slots 2 of contact 1 have cut into the insulation of conductor 4, and that at the same time a portion of conductor 4 is also forced into conductor-retention groove 12 adjacent to contact 1. Although retaining arms 13 will resist the conductor as it is forced down between them, they are then deflected by the conductor and will revert to their initial configuration after the conductor is positioned in groove 12 because these arms are resilient.

It can be seen in FIG. 3 that first projections 14 on retention arms 13 and second projection 15 at the bottom of conductor-retention groove 12 firmly engage insulation 4*b* and clamp conductor 4 in groove 12. Hence, an axial force that may be exerted on conductor 4 in a direction away from the connector will be prevented from being conveyed down to the termination of conductor 4 in slots 2 by the clamping forces of first and the second projections 14, 15, which can eliminate the electric connection failure that may otherwise occur. Thus, the clamping forces act as a strain relief on the conductor thereby protecting the termination. The clamping forces will also counteract any upwardly-directed forces on the conductor.

Also, in soldering the connector to a printed circuit board and the like, shrinkage of the insulation of conductor 4 away from the termination in slots 2 to expose conductor core 4*b* does not occur if the soldering heat is conducted from contact 1 to slots 2 due to the fact that the clamping forces generated by first and second projections 14, 15, respectively, prevent the shrinkage form taking place thereby maintaining the insulation in place at the termination slots resulting in a sealed termination.

Although in the above example the connector is equipped with first projections 14 on retention arms 13 and second projections 15 at the bottom of conductor-retention grooves 12 as well, second projections 15 may not be necessary because only first projections 14 may suffice for many applications.

As described above, the present invention discloses an electrical connector free of electrical connection failure by a conductor-retention groove adjacent to each electrical contact in the housing for retaining the portion of the electrical conductor which is forced into the slots of an electrical contact; resilient retention arms at the open end of each retention groove; and first projections on the conductor-retention arms for clamping the portion of the conductor to be received in the groove, to thereby prevent an external force acting on the conductor from being conveyed down to the termination of the conductor in the slots. The clamping by the first projections is also effective to prevent the shrinkage of the insulation of the conductor adjacent the slots and to prevent the resultant exposition of the conductor core caused by the heat generated in soldering the contact legs to a printed circuit board and the like.

We claim:

1. An electrical connector, comprising:

a dielectric housing having aligned contact-receiving and conductor-retaining sections opening outwardly;

an electrical contact having a termination section disposed in said contact-receiving section and a soldering leg extending outwardly from a bottom surface of said housing for soldered connection to a circuit board;

said conductor-retaining section having a generally semicircular portion and including a pair of resilient conductor-retention members extending upwardly from said semi-circular portion, said members including vertical legs and inwardly-directed legs, with the inwardly-directed legs being spaced from and facing one another thereby providing a groove therebetween whereby an electrical conductor can be inserted through said groove into the semi-circular portion past free ends of the inwardly-directed legs; and projections having sharp edges provided at said free ends of said inwardly-directed legs and also extending upwardly from a bottom of said semi-circular groove, said projections being disposed in a place perpendicular to an axis of said conductor-retaining section so that said projections firmly engage the insulation of the conductor when inserted within the conductor-retaining section to provide an axial strain relief thereon and to prevent the insulation of the conductor from shrinking away from the termination between the conductor and the termination section when heat is applied to said soldering leg.

* * * * *

UNITED STATES PATENT AND TRADEMARK OFFICE

CERTIFICATE OF CORRECTION

PATENT NO. : 5,073,126

DATED : December 17, 1991

INVENTOR(S) : Shoji Kikuchi, et al

It is certified that error appears in the above-identified patent and that said Letters Patent is hereby corrected as shown below:

Claim 1, column 4, line 49, delete the word "place" and insert --plane--.

Signed and Sealed this

Eleventh Day of May, 1993

*Attest:*

Michael K. Kirk

MICHAEL K. KIRK

*Attesting Officer*

*Acting Commissioner of Patents and Trademarks*